US008283906B2

(12) United States Patent
Shito

(10) Patent No.: US 8,283,906 B2
(45) Date of Patent: Oct. 9, 2012

(54) VOLTAGE REGULATOR

(75) Inventor: Rie Shito, Chiba (JP)

(73) Assignee: Seiko Instruments Inc., Chiba (JP)

( * ) Notice: Subject to any disclaimer, the term of this patent is extended or adjusted under 35 U.S.C. 154(b) by 345 days.

(21) Appl. No.: 12/707,041

(22) Filed: Feb. 17, 2010

(65) Prior Publication Data

US 2010/0213913 A1 Aug. 26, 2010

(30) Foreign Application Priority Data

Feb. 20, 2009 (JP) ..... 2009-038146

(51) Int. Cl.
*G05F 1/00* (2006.01)

(52) U.S. Cl. ..... 323/280

(58) Field of Classification Search ..... 323/273–281, 323/312–318
See application file for complete search history.

(56) References Cited

U.S. PATENT DOCUMENTS 7,456,619 B2 * 11/2008 Sasaki et al. ..... 323/280
7,659,703 B1 * 2/2010 Fesler et al. ..... 323/280
7,728,569 B1 * 6/2010 Le et al. ..... 323/280
7,965,067 B2 * 6/2011 Gronthal et al. ..... 323/280
2001/0026149 A1 10/2001 Kanakubo
2005/0162141 A1 7/2005 Kanakubo

FOREIGN PATENT DOCUMENTS

JP 2001-282371 A 10/2001
JP 2005-215897 A 8/2005

* cited by examiner

*Primary Examiner* — Jue Zhang
(74) *Attorney, Agent, or Firm* — Brinks Hofer Gilson & Lione

(57) ABSTRACT

Provided is a voltage regulator that is capable of improving a transient response characteristic while suppressing current consumption. A fluctuating output voltage is detected without increasing the current consumption of a differential amplifier, and a phase compensation resistor (60) is temporarily short-circuited, to thereby decrease a time constant determined by a parasitic capacitance of an output transistor (40) and the phase compensation resistor (60) to improve the transient response characteristic. Alternatively, a voltage divider circuit (50) is short-circuited to temporarily increase the current consumption and correct the output voltage, with the result that the current consumption during a normal operation is relatively low, and the transient response characteristic is improved by increasing a current only during a transient response.

4 Claims, 9 Drawing Sheets

VOLTAGE REGULATOR

RELATED APPLICATIONS

This application claims priority under 35 U.S.C. §119 to Japanese Patent Application No. 2009-038146 filed on Feb. 20, 2009, the entire content of which is hereby incorporated by reference.

BACKGROUND OF THE INVENTION

1. Field of the Invention

The present invention relates to a voltage regulator that operates so as to keep an output voltage constant.

2. Description of the Related Art

In a technology for a related art voltage regulator, as illustrated in FIG. 9, an output voltage of a reference voltage circuit 21 and a voltage determined by dividing a voltage of an output terminal by a voltage divider resistor 51 are compared with each other by a voltage amplifier circuit 31 to control a PMOS transistor 41. For the purpose of obtaining a stable output voltage with respect to a power fluctuation, there is a need to allow a current to always flow regardless of a power fluctuation level (for example, refer to JP 2001-282371 A). Further, a phase of the entire system is compensated by a phase compensation circuit 61. The phase compensation circuit 61 includes a phase compensation capacitor 61*a* and a phase compensation resistor 61*b* (for example, refer to JP 2005-215897 A). The phase of the entire system is easily compensated by the phase compensation circuit 61, but the transient characteristic is deteriorated.

In general, in order to improve a response of the voltage regulator, a current consumption of the voltage amplifier circuit 31 needs to be increased. Therefore, the current consumption may not be reduced in the related art voltage regulator.

Further, in the phase compensation circuit 61 of the voltage regulator, a resistance value of the phase compensation resistor 61*b* may be set to be larger for the stable operation of the voltage regulator. As the output voltage of the voltage regulator changes, the output voltage of the voltage amplifier circuit 31 also changes. In a transient state where the output voltage of the voltage amplifier circuit 31 changes, when the resistance value of the phase compensation resistor 61*b* is large, it takes time to charge or discharge the gate of the output transistor 41.

FIGS. 10A and 10B are diagrams illustrating an input voltage and an output voltage of the phase compensation circuit in the related art voltage regulator, respectively. When an input voltage V1 of the phase compensation circuit 61 changes as illustrated in FIG. 10A, an output voltage V2 of the phase compensation circuit 61 changes as illustrated in FIG. 10B. When the resistance value of the phase compensation resistor 61*b* is small, the output voltage V2 is changed as indicated by a dotted line of FIG. 10B. On the other hand, when the resistance value of the phase compensation resistor 61*b* is large, the output voltage V2 is changed as indicated by a solid line of FIG. 10B. That is, there arises such a problem that the transient response characteristic is deteriorated by the phase compensation circuit 61, and the transient response characteristic of the voltage regulator is deteriorated.

SUMMARY OF THE INVENTION

The present invention has an object to provide a voltage regulator that is excellent in transient response characteristic even when a resistance value of a phase compensation resistor is large, and is relatively low in current consumption during normal operation.

The present invention provides a voltage regulator that operates so as to keep an output voltage constant, including: an output transistor for outputting the output voltage; a voltage divider circuit for dividing the output voltage to be supplied to an external load to output a divided voltage; a first differential amplifier for comparing a reference voltage with the divided voltage to output a signal; a second differential amplifier for amplifying only an AC component of the output voltage; a phase compensation resistor for compensating a phase of a control terminal of the output transistor; and a switch for receiving an output of the second differential amplifier and short-circuiting at least one of the phase compensation resistor and the voltage divider circuit when the output voltage fluctuates by a given voltage or higher.

In the present invention, the fluctuating output voltage is detected without increasing the current consumption of the differential amplifier, and the phase compensation resistor is temporarily short-circuited, to thereby decrease a time constant determined by a parasitic capacitance of the output transistor and the phase compensation resistor to improve the transient response characteristic. Alternatively, the voltage divider circuit is short-circuited to temporarily increase the current consumption and correct the output voltage, with the result that the current consumption during the normal operation is relatively low, and a transient response is improved by increasing a current only during the transient response.

Hence, there may be obtained the voltage regulator that is excellent in transient response characteristic while suppressing the current consumption.

DETAILED DESCRIPTION OF THE PREFERRED EMBODIMENTS

Hereinafter, embodiments of the present invention are described with reference to the accompanying drawings.

First Embodiment

Figure 1:
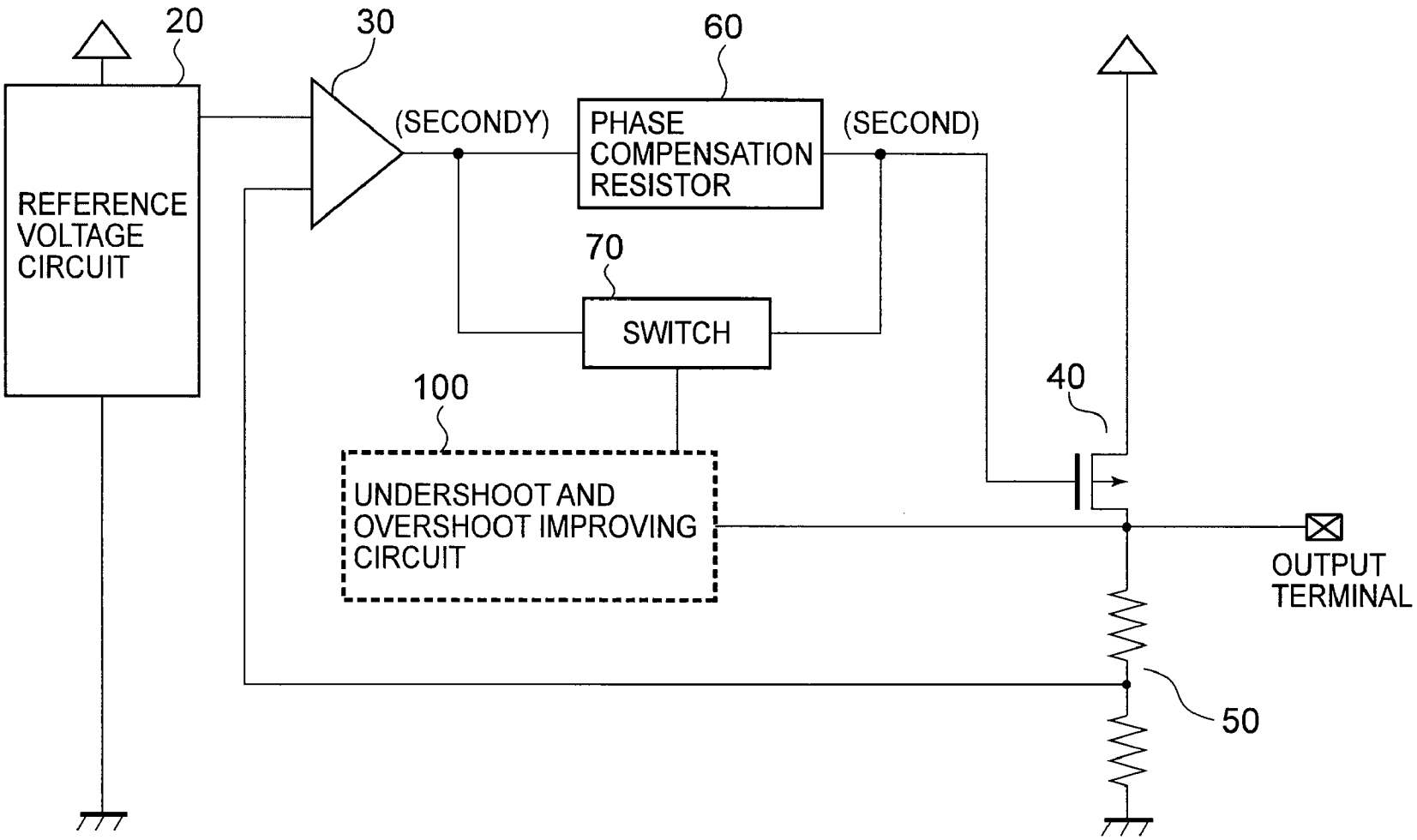
FIG. 1 is a diagram illustrating a circuit example of a voltage regulator according to a first embodiment of the present invention.
Figure 2:
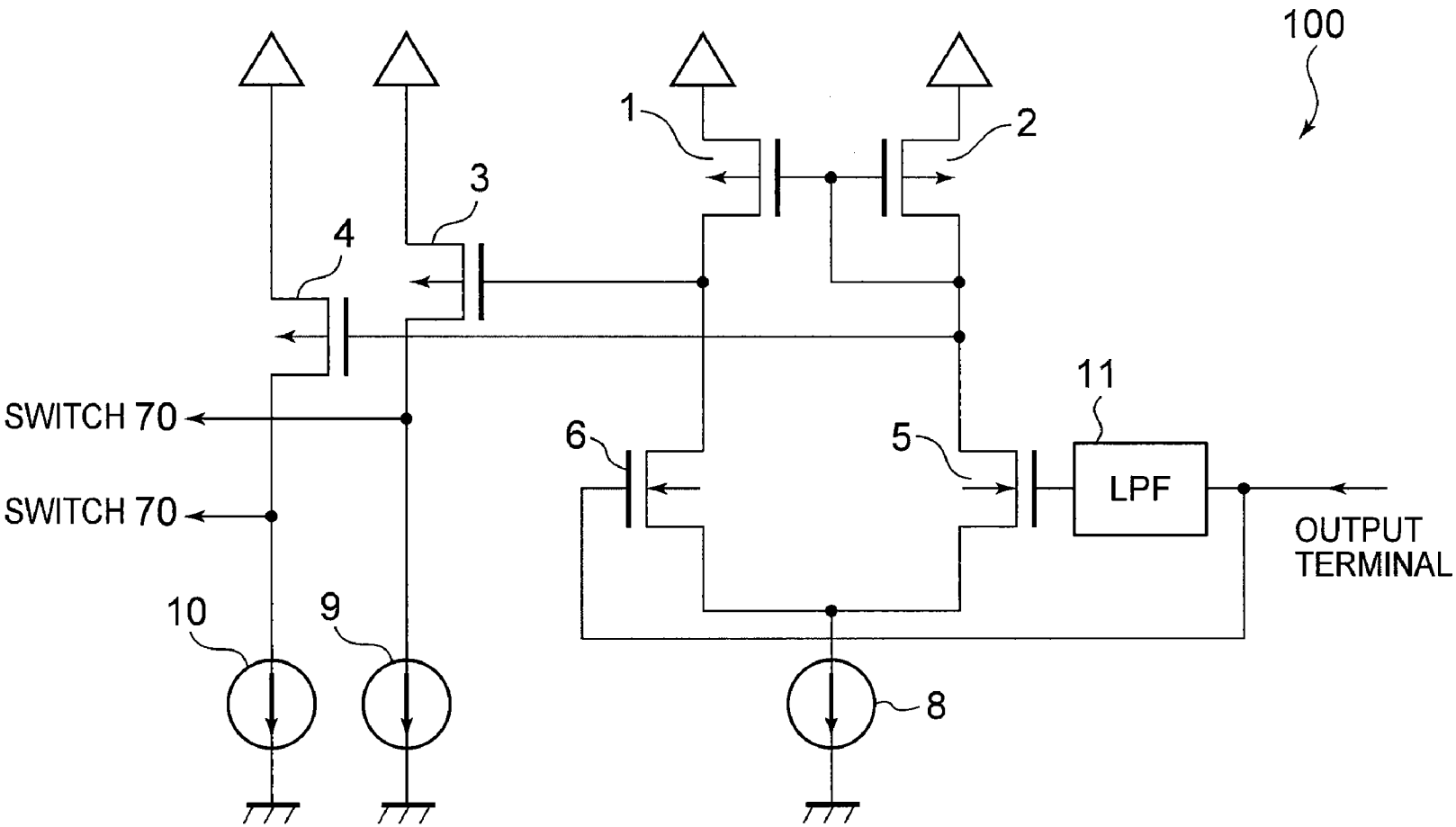
FIG. 2 is a diagram illustrating an undershoot and overshoot improving circuit.

FIG. 1 illustrates a voltage regulator according to a first embodiment. FIG. 2 illustrates an undershoot and overshoot improving circuit 100. The undershoot and overshoot improving circuit 100 is configured to detect a fluctuation of an output voltage, and operates so as to reduce the fluctuation. Hereinafter, the configuration and operation of the undershoot and overshoot improving circuit 100 are described.

The voltage regulator includes a reference voltage circuit 20, a differential amplifier 30, an output transistor 40, a voltage divider circuit 50, a phase compensation resistor 60, a switch 70 that short-circuits the phase compensation resistor 60, and the undershoot and overshoot improving circuit 100. The undershoot and overshoot improving circuit 100 includes PMOS transistors (PMOS) 1 to 4, NMOS transistors (NMOS) 5 and 6, constant current circuits 8 to 10, and a low-pass filter (LPF) 11.

The output transistor 40 has a gate connected to an output terminal of the differential amplifier 30 through the phase compensation resistor 60, a source connected to a power supply terminal, and a drain connected to an output terminal of the voltage regulator and the voltage divider circuit 50. The switch 70 is connected in parallel to the phase compensation resistor 60. The voltage divider circuit 50 is disposed between the output terminal of the voltage regulator and a ground terminal. The differential amplifier 30 has an inverting input terminal connected to a voltage dividing terminal of the voltage divider circuit 50, and a non-inverting input terminal connected to a reference voltage terminal. The undershoot and overshoot improving circuit 100 is connected to the output terminal of the voltage regulator, and detects an AC component of the output voltage when the output voltage fluctuates, to thereby control the switch 70 to short-circuit the phase compensation resistor 60.

In the undershoot and overshoot improving circuit 100, the output voltage and an output voltage that has passed through the LPF 11 are input to gate electrodes of the NMOSs 6 and 5, respectively, to detect the fluctuation of the output voltage. Source electrodes of the NMOSs 5 and 6 are common to each other, and connected to the constant current circuit 8. Drain electrodes of the NMOSs 6 and 5 are connected to drain electrodes of the PMOSs 1 and 2 forming a current mirror circuit, and gate electrodes of the PMOSs 3 and 4, respectively. Drain electrodes of the PMOSs 3 and 4 are connected to the constant current circuits 9 and 10 and the switch 70, respectively.

Hereinafter, the operation performed when the output voltage fluctuates is described.

When undershoot occurs, the output voltage and the output voltage from which a high frequency component has been removed through the LPF 11 are input to the gate electrode of the NMOS 6 and the gate electrode of the NMOS 5, which are a differential pair, respectively. In this situation, a condition of "gate voltage of NMOS 5>gate voltage of NMOS 6" is satisfied, and the drain voltage of the NMOS 5 is decreased. Accordingly, the gate voltage of the PMOS 4 is decreased, and the switch 70 starts to operate, and hence the phase compensation resistor 60 is short-circuited. As a result, a time constant determined by the parasitic capacitance of the output transistor 40 and the phase compensation resistor 60 is decreased to improve the transient response characteristic.

When overshoot occurs, signals are input to the differential pair in the same manner as in the above-mentioned case. A condition of "gate voltage of NMOS 5<gate voltage of NMOS 6" is satisfied, and the drain voltage of the NMOS 6 is decreased. Accordingly, the gate voltage of the PMOS 3 is decreased, and the switch 70 starts to operate, and hence the phase compensation resistor 60 is short-circuited. As a result, a time constant determined by the parasitic capacitance of the output transistor 40 and the phase compensation resistor 60 is decreased to improve the transient response characteristic.

When the output voltage is held constant, signals are input to the differential pair in the same manner as in the above-mentioned case. No high frequency component exists, and hence a condition of "gate voltage of NMOS 5=gate voltage of NMOS 6" is satisfied. As a result, the gate voltages of the PMOSs 3 and 4 do not change, and the switch 70 does not operate.

Further, when the PMOS 3 and the constant current circuit 9 are removed from the undershoot and overshoot improving circuit 100, the transient characteristic may be improved only during undershoot.

Further, when the PMOS 4 and the constant current circuit 10 are removed from the undershoot and overshoot improving circuit 100, the transient characteristic may be improved only during overshoot.

Figure 7:
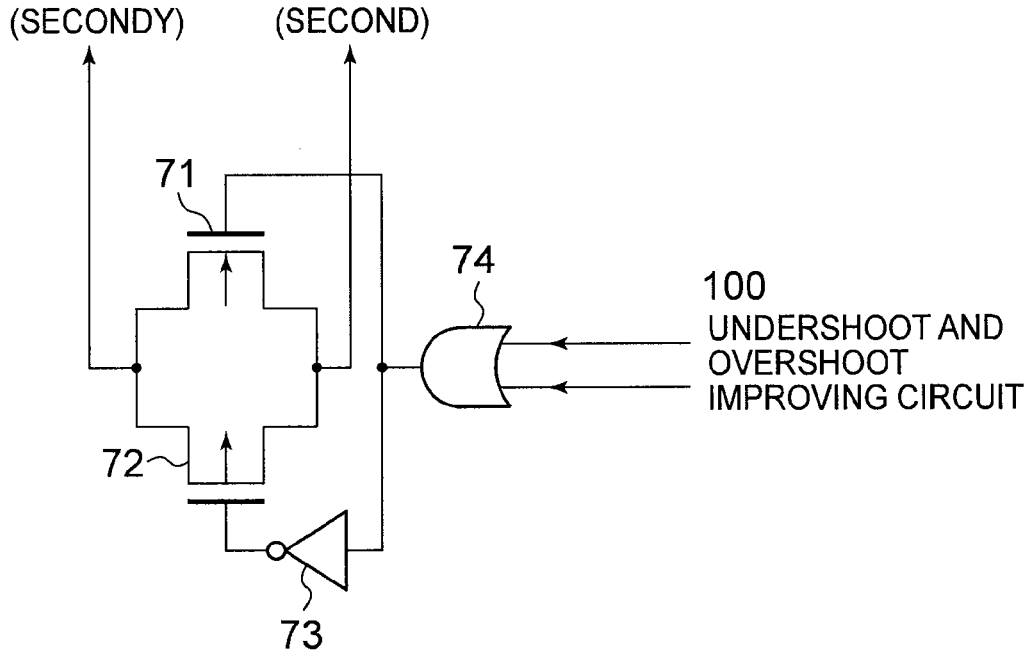
FIG. 7 is a diagram illustrating a switch circuit according to the first embodiment of the present invention.

An example of the switch 70 is illustrated in FIG. 7. The switch 70 includes an NMOS 71, a PMOS 72, a NOT circuit 73, and an OR circuit 74.

The OR circuit 74 has an input terminal connected with the output terminal of the undershoot and overshoot improving circuit 100, and an output terminal connected to a gate electrode of the NMOS 71 and an input terminal of the NOT circuit 73. An output terminal of the NOT circuit 73 is connected to a gate electrode of the PMOS 72, and source electrodes and drain electrodes of the NMOS 71 and the PMOS 72 are connected to SECONDY and SECOND, respectively.

When a signal is input from the undershoot and overshoot improving circuit 100, the OR circuit 74 operates, and outputs a supply voltage. Accordingly, the NMOS 71 turns on. Further, the NOT circuit 73 outputs the ground voltage from the output terminal thereof, and the PMOS 72 turns on. As a result, the SECONDY and the SECOND are short-circuited.

Second Embodiment

Figure 3:
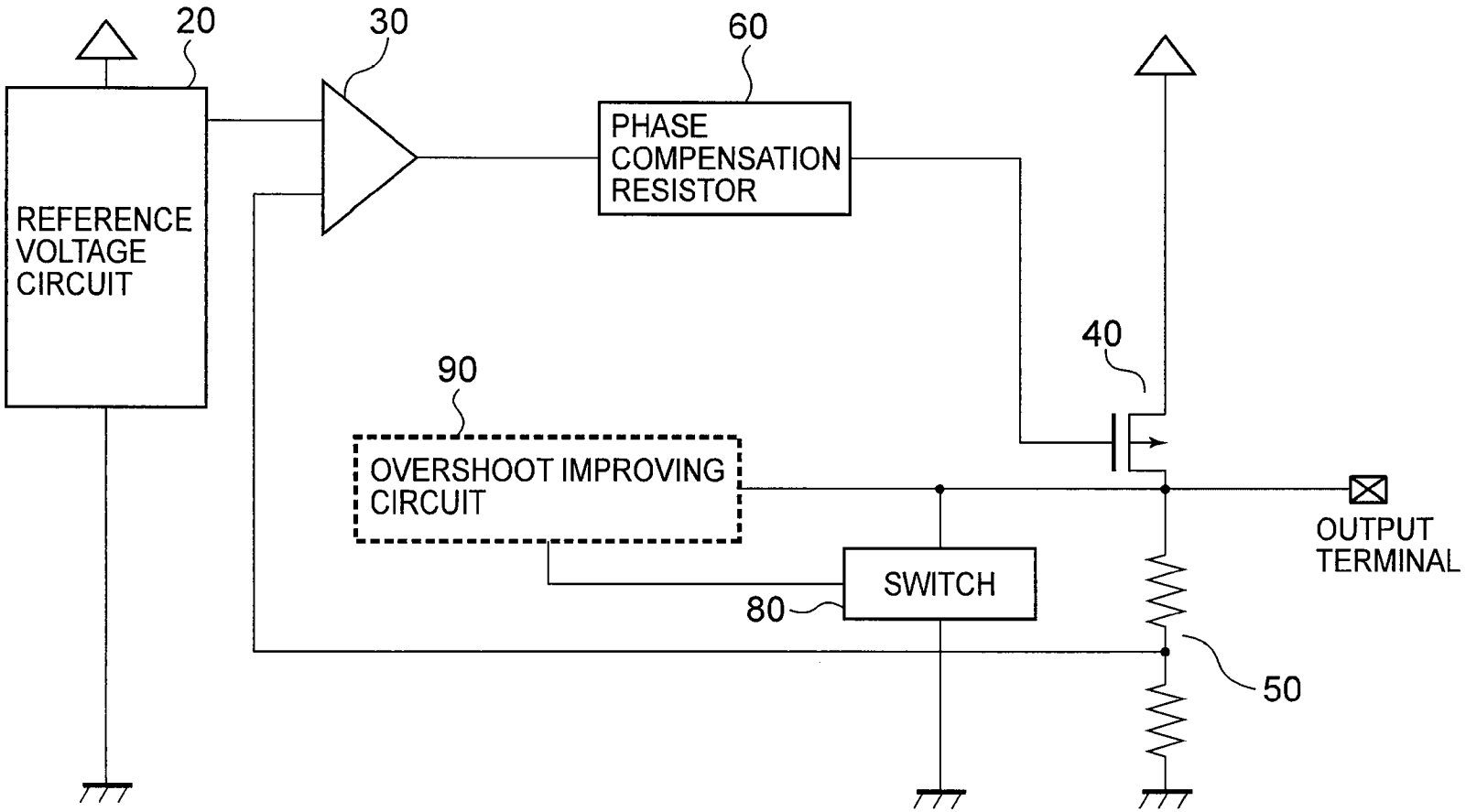
FIG. 3 is a diagram illustrating a circuit diagram of a voltage regulator according to a second embodiment of the present invention.
Figure 4:
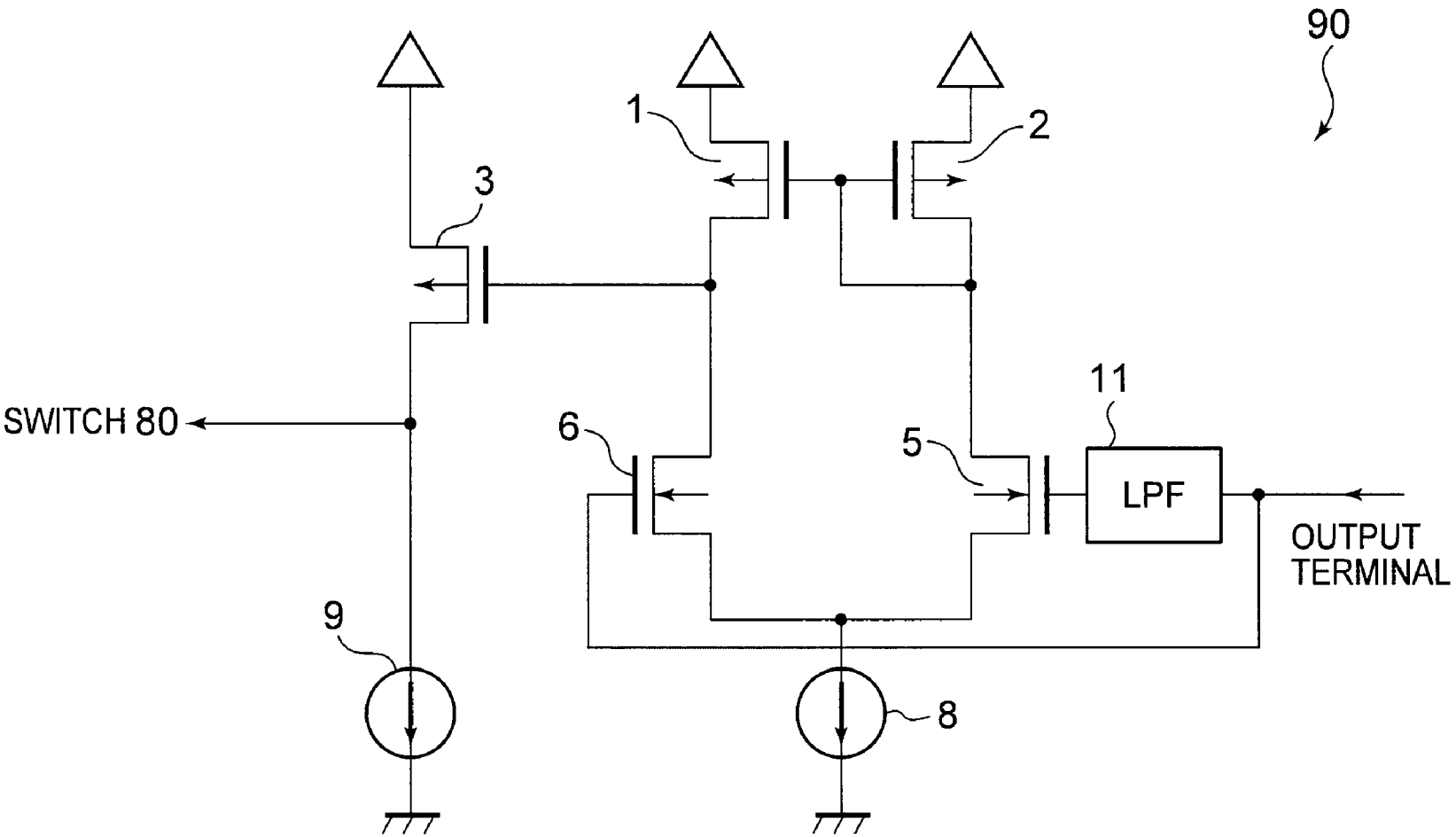
FIG. 4 is a diagram illustrating an overshoot improving circuit.
Figure 8:
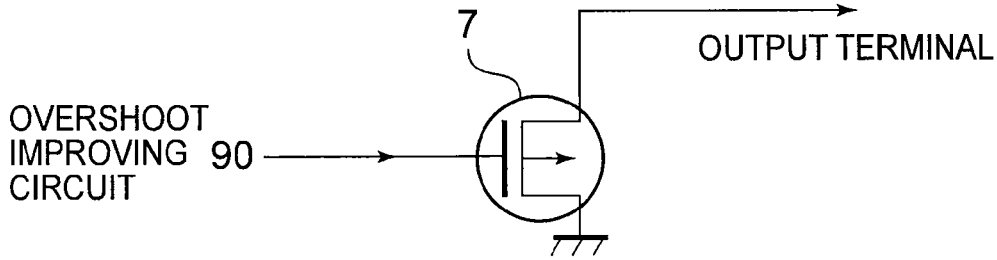
FIG. 8 is a diagram illustrating a switch circuit according to the second embodiment of the present invention.
Figure 9:
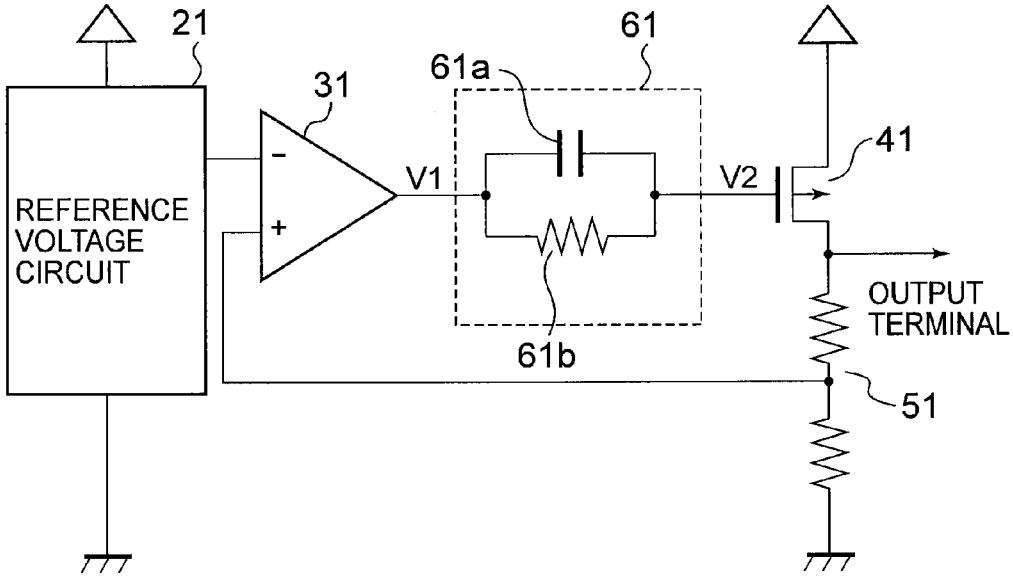
FIG. 9 PRIOR ART
FIG. 9 is a diagram illustrating a related art voltage regulator.
Figure 10A:
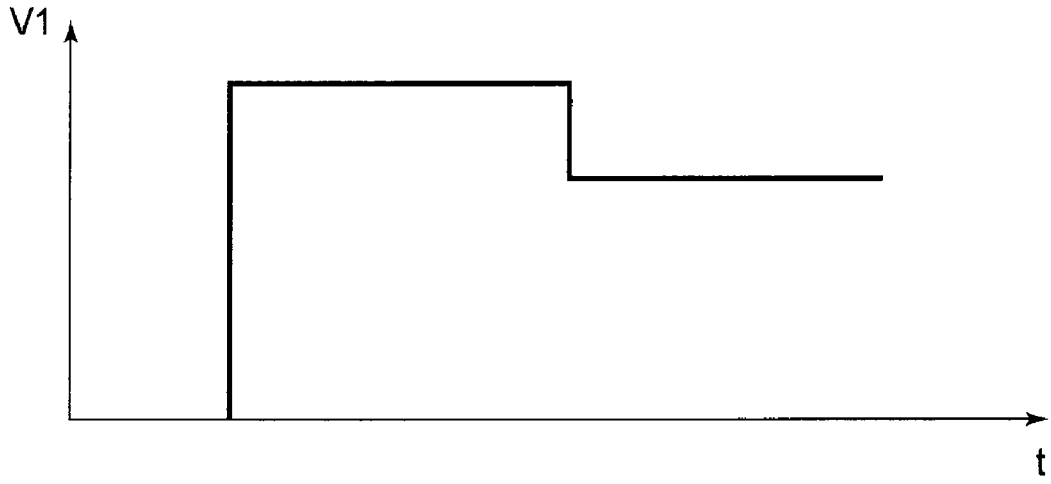
FIG. 10A PRIOR ART
FIGS. 10A and 10B are diagrams illustrating an input voltage and an output voltage of a phase compensation circuit in a related art voltage regulator, respectively.
Figure 10B:
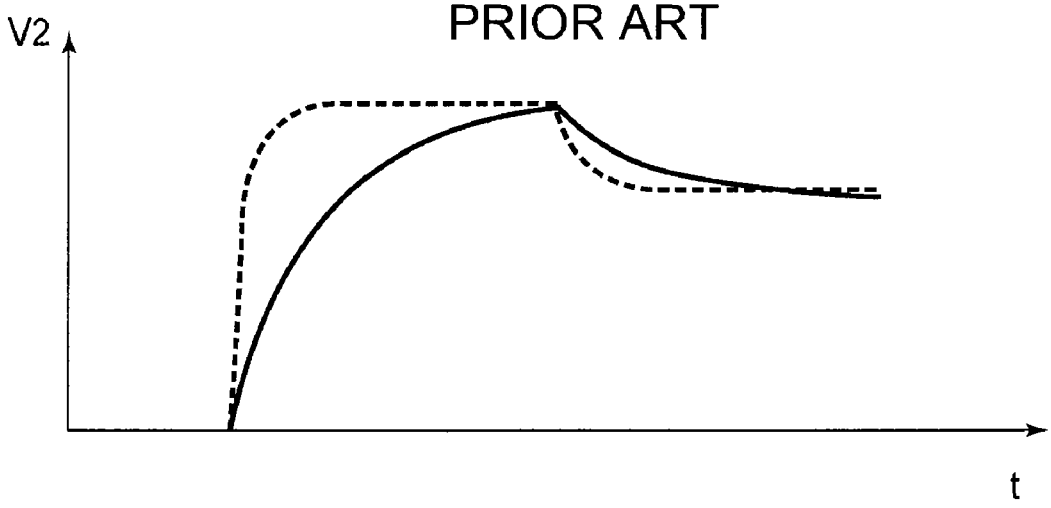
FIG. 10B PRIOR ART

FIG. 3 illustrates a voltage regulator according to a second embodiment. FIG. 4 illustrates an overshoot improving circuit 90. FIG. 8 illustrates a switch 80. The reference voltage circuit 20, the differential amplifier 30, the output transistor 40, the voltage divider circuit 50, and the phase compensation resistor 60 are identical with those in the first embodiment. A difference from the first embodiment resides in that the switch 70 and the undershoot and overshoot improving circuit 100 are removed from the voltage regulator, and the switch 80 and the overshoot improving circuit 90 are inserted into the voltage regulator.

The overshoot improving circuit 90 includes PMOSs 1 to 3, NMOSs 5 and 6, constant current circuits 8 and 9, and an LPF 11. The switch 80 includes an NMOS 7.

The overshoot improving circuit 90 is connected to the output terminal of the voltage regulator, and detects an AC component of the output voltage when the output voltage fluctuates, to thereby control the switch 80 to short-circuit the voltage divider resistor 50.

In the overshoot improving circuit 90, the PMOSs 1 and 2, the NMOSs 5 and 6, the constant current circuit 8, and the LPF 11 are identical with those in the undershoot and overshoot improving circuit 100. A difference from the first embodiment resides in that the PMOS 4 and the constant current circuit 10 are eliminated. Further, the drain electrode of the PMOS 3 is connected to the switch 80.

The NMOS 7 has a gate electrode connected to an output terminal of the overshoot improving circuit 90, a source electrode connected to the ground terminal, and a drain electrode connected to the output terminal of the voltage regulator.

Hereinafter, the operation performed when a load fluctuates is described.

When undershoot occurs, signals are input to the differential pair in the same manner as in the first embodiment, a condition of "gate voltage of NMOS 5>gate voltage of NMOS 6" is satisfied, and the drain voltage of the NMOS 6 is increased. The NMOS 7 does not operate, and the transient characteristic is not improved during undershoot.

When overshoot occurs, signals are input to the differential pair in the same manner as in the first embodiment. A condition of "gate voltage of NMOS 5<gate voltage of NMOS 6" is satisfied, and the drain voltage of the NMOS 6 is decreased. As a result, the gate voltage of the PMOS 3 is decreased, the NMOS 7 turns on, and the output voltage is decreased to adjust the output voltage. In this situation, the switch 80, that is, the NMOS 7 operates, to thereby increase the current consumption. However, the NMOS 7 operates only during the transient response, and hence the current consumption during the normal operation may be suppressed.

When the output voltage is held constant, signals are input to the differential pair in the same manner as in the first embodiment. No high frequency component exists, and hence a condition of "gate voltage of NMOS 5=gate voltage of NMOS 6" is satisfied. As a result, the gate voltage of the PMOS 3 does not change, and the switch 80 does not operate.

Even when the phase compensation resistor 60 is not provided, the transient characteristic may be improved by the same operation as those described above.

Third Embodiment

Figure 5:
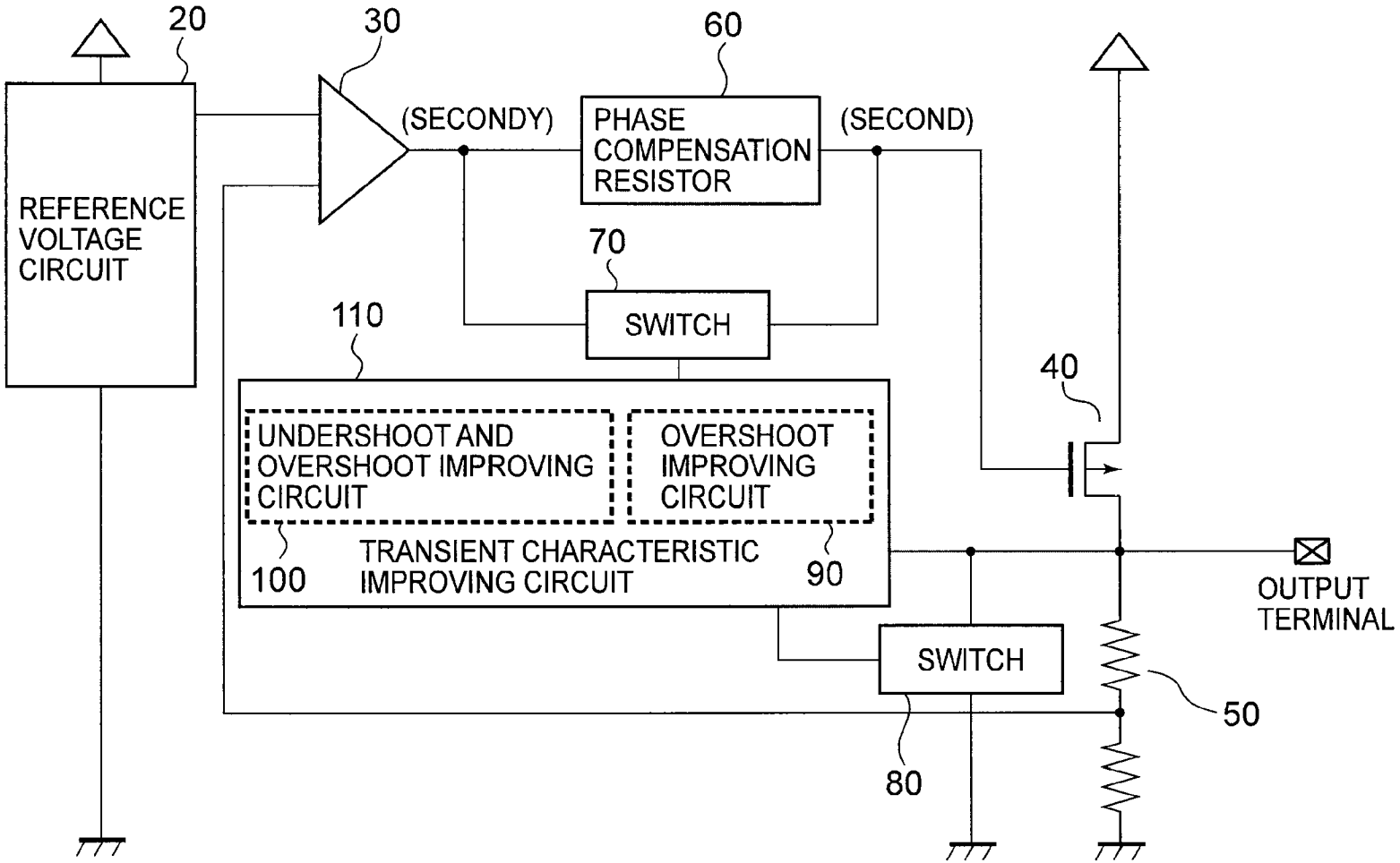
FIG. 5 is a diagram illustrating a circuit diagram of a voltage regulator according to a third embodiment of the present invention.
Figure 6:
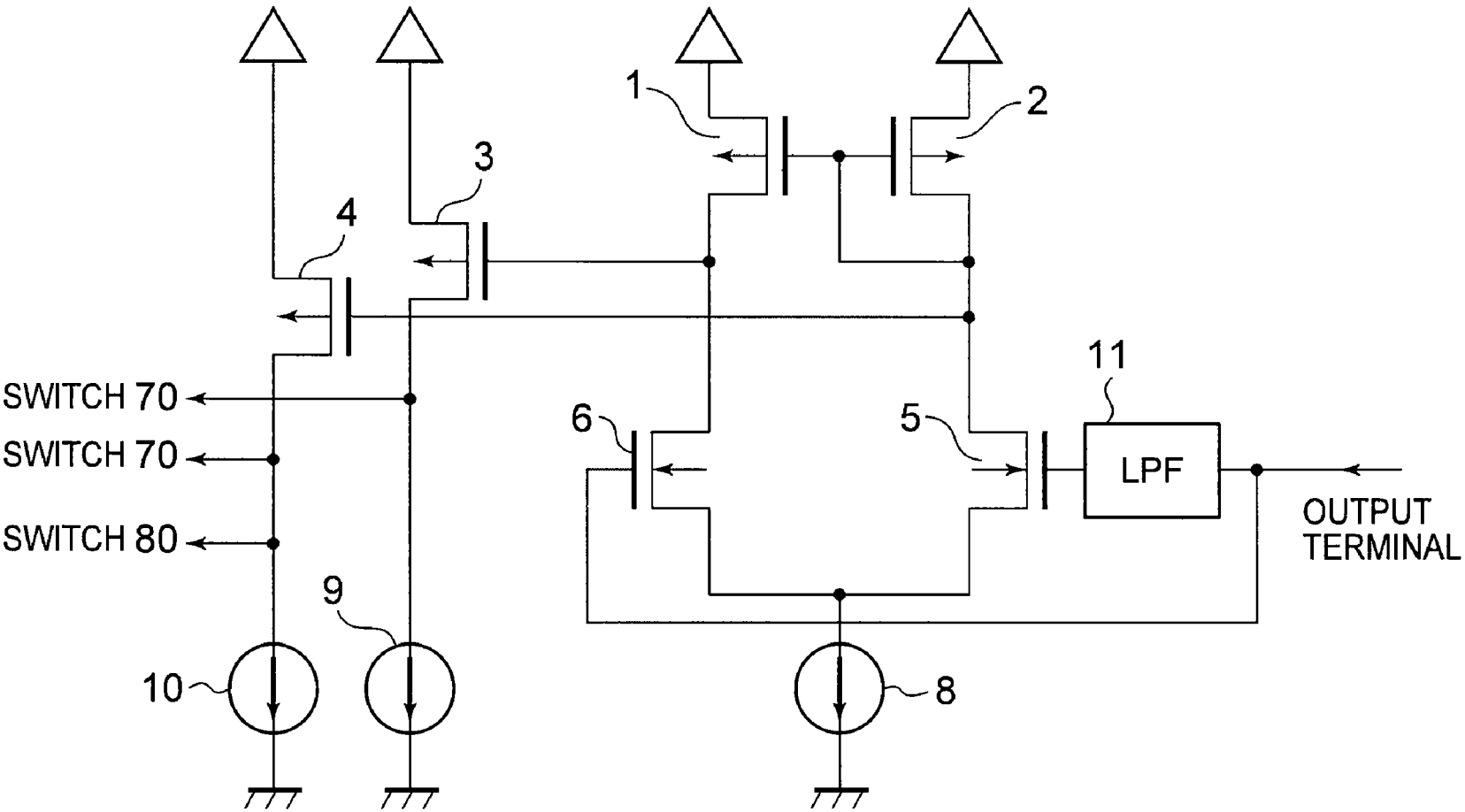
FIG. 6 is a diagram illustrating a transient characteristic improving circuit.

FIG. 5 illustrates a voltage regulator according to a third embodiment, which has a configuration obtained by combining the first embodiment and the second embodiment. FIG. 6 illustrates a transient characteristic improving circuit 110. The reference voltage circuit 20, the differential amplifier 30, the output transistor 40, the voltage divider circuit 50, the phase compensation resistor 60, and the switch 70 are identical with those in the first embodiment. A difference from the first embodiment resides in that the undershoot and overshoot improving circuit 100 is removed from the voltage regulator, and the transient characteristic improving circuit 110 and a switch 80 are inserted into the voltage regulator.

The transient characteristic improving circuit 110 is connected to the output terminal of the voltage regulator, and detects an AC component of the output voltage when the output voltage fluctuates, to thereby control the switch 80 to short-circuit the voltage divider resistor 50.

The transient characteristic improving circuit 110 is configured by the combination of the undershoot and overshoot improving circuit 100 with the overshoot improving circuit 90.

Hereinafter, the operation performed when the output voltage fluctuates is described.

When undershoot occurs, in the same manner as in the first embodiment, the phase compensation resistor 60 is short-circuited to improve the transient characteristic.

When overshoot occurs, in the same manner as in the first embodiment, the phase compensation resistor 60 is short-circuited to improve the transient characteristic. At the same time, the voltage divider resistor 50 is short-circuited in the same manner as in the second embodiment to adjust the output voltage. In this situation, the switch 80 turns on to increase the current consumption. However, the switch 80 operates only during the transient response, and hence the current consumption during the normal operation may be relatively suppressed.

When the output voltage is held constant, in the same manner as in the first embodiment and the second embodiment, the switch 70 does not operate, and the switch 80 also does not operate.

What is claimed is:

1. A voltage regulator that operates so as to keep an output voltage constant, comprising:

an output transistor for outputting the output voltage;

a voltage divider circuit for dividing the output voltage to be supplied to an external load to output a divided voltage;

a first differential amplifier for comparing a reference voltage with the divided voltage to output a signal;

a second differential amplifier for amplifying only an AC component of the output voltage, wherein the second differential amplifier has one input terminal input with the output voltage, and another input terminal input with the output voltage from which a high frequency component is removed through a low-pass filter, and amplifies only the AC component of the output voltage; and a switch for receiving an output of the second differential amplifier and short-circuiting at least one of a phase compensation resistor and the voltage divider circuit when the output voltage fluctuates by a given voltage or higher, the phase compensation resistor compensating a phase of a control terminal of the output transistor.

2. A voltage regulator according to claim 1, wherein the phase compensation resistor is connected between an output terminal of the first differential amplifier and the control terminal of the output transistor, wherein the switch includes a first switch connected in parallel to the phase compensation resistor, and a second switch connected in parallel to the voltage divider circuit, and wherein the second differential amplifier controls the first switch and the second switch to short-circuit the phase compensation resistor and the voltage divider circuit when the output voltage overshoots, and controls the first switch to short-circuit the phase compensation resistor when the output voltage undershoots.

3. A voltage regulator according to claim 1, wherein the phase compensation resistor is connected between an output terminal of the first differential amplifier and the control terminal of the output transistor, wherein the switch includes a first switch connected in parallel to the phase compensation resistor, and wherein the second differential amplifier controls the first switch to short-circuit the phase compensation resistor one of when the output voltage overshoots and when the output voltage undershoots.

4. A voltage regulator according to claim 1, wherein the switch includes a second switch connected in parallel to the voltage divider circuit, and wherein the second differential amplifier controls the second switch to short-circuit the voltage divider circuit when the output voltage overshoots.

* * * * *